US005229738A

United States Patent [19]

Knapen

[11] Patent Number: 5,229,738

[45] Date of Patent: Jul. 20, 1993

[54] MULTIPOLAR ROTOR

[75] Inventor: Petrus M. J. Knapen, Tilburg, Netherlands

[73] Assignee: Kinetron B.V., Tilburg, Netherlands

[21] Appl. No.: 559,512

[22] Filed: Jul. 23, 1990

Related U.S. Application Data

[63] Continuation of Ser. No. 205,197, Jun. 10, 1988, abandoned.

[30] Foreign Application Priority Data

Jun. 16, 1987 [NL] Netherlands ..... 8701394

[51] Int. Cl.[5] ..... H01F 3/00; H01F 7/02

[52] U.S. Cl. ..... 335/303; 310/156

[58] Field of Search ..... 335/303, 302; 310/156, 310/268

[56] References Cited

U.S. PATENT DOCUMENTS

| | | | |
|---|---|---|---|
| 3,840,763 | 10/1974 | Baumann et al. | 310/156 |
| 3,869,627 | 3/1975 | Ingenito et al. | 310/156 X |
| 3,872,334 | 3/1975 | Loubier | 310/156 X |
| 3,985,588 | 10/1976 | Lyman | 148/103 |
| 4,079,274 | 3/1978 | Richmond | 310/156 X |
| 4,115,714 | 9/1978 | Ingenito et al. | 310/156 X |
| 4,185,262 | 1/1980 | Watanabe et al. | 335/302 |
| 4,513,216 | 4/1985 | Muller | 310/156 |
| 4,549,157 | 10/1985 | Loubier | 310/156 X |
| 4,604,042 | 8/1986 | Tanigawa et al. | 425/3 |
| 4,678,616 | 7/1987 | Kawashima | 264/24 |
| 4,689,163 | 8/1987 | Yamashita | 252/62.54 |
| 4,702,852 | 10/1987 | Sakauchi et al. | 252/62.54 |
| 4,810,572 | 3/1989 | Ooe | 428/323 |
| 4,873,504 | 10/1989 | Blume | 335/303 |

FOREIGN PATENT DOCUMENTS

| | | | |
|---|---|---|---|
| 81225 | 6/1983 | European Pat. Off. | 335/302 |
| 0092422 | 10/1983 | European Pat. Off. . | |
| 56-61104 | 5/1981 | Japan | 335/302 |
| 59-72701 | 4/1984 | Japan . | |
| 60-214515 | 10/1985 | Japan . | |
| 60-216512 | 10/1985 | Japan . | |
| 60-223107 | 11/1985 | Japan . | |
| 61-87309 | 5/1986 | Japan . | |
| 61-125010 | 6/1986 | Japan . | |
| 61-225814 | 10/1986 | Japan . | |
| 62-52913 | 3/1987 | Japan . | |
| 60-227673 | 4/1987 | Japan . | |
| 817890 | 4/1981 | U.S.S.R. | 264/24 |

OTHER PUBLICATIONS

Shimoda, T. et al. "New Resin-Bonded $Sm_2Co_{17}$ Type Magnets." *IEEE Transactions on Magnetics*, vol. 16, No. 5 (Sep. 1980), pp. 991-993.

*Primary Examiner*—Leo P. Picard
*Assistant Examiner*—Raymond Barrera
*Attorney, Agent, or Firm*—Fay, Sharpe, Beall, Fagan, Minnich & McKee

[57] ABSTRACT

A magnetic object having a plurality of pole regions of small dimensions and adapted to be molded in a molding device. The object includes a body of a given shape, for instance a cylindrical block or a cylindrical sleeve having an outer diameter smaller than 5 mm, and including alternating north and south poles. The body is made of a mixture of grains of fully magnetized anisotropic permanent magnet material and a hardening binding agent. The grains are reduced from a permanent magnet until all grains are smaller than the smallest dimension of a pole region and in the pole regions at least those grains having a size of the same range of size as the smallest dimension of a pole region are distributed in accordance with the alternating north and south poles.

11 Claims, 4 Drawing Sheets

MULTIPOLAR ROTOR

This is a continuation of copending application Ser. No. 0/205,197 filed on Jun. 10, 1988 now abandoned.

BACKGROUND OF THE INVENTION

The invention relates to a method and device for producing permanently magnetized objects, and multipolar rotors of small dimensions in particular.

The method according to the invention relates to the production of a magnetic object to be molded in a molding device from a mixture of grains of magnetic material and hardening binding agent, said object having pole regions of small dimensions, the mixture being subjected in a molding cavity of a molding body of the molding device to temperature changes, gravity, mechanical forces or magnetic forces, or combinations of these forces.

It is generally known how to produce magnetic bodies by means of magnetic material bound by resin or a suitable synthetic material according to which method pulverized or granulated sintered magnetic material such as $SmCo_5$, and $Sm_2Co_{17}$ is processed, while adding a suitable binding agent, into semi-finished product magnetic elements in a mass production process. By using the correct grain size for the magnetic material, desired filling factors can be obtained. The produced semi-finished magnetic elements, having no or only slight net-magnetization, can then be processed further, e.g., to adhering strips, in which process they finally can be magnetized permanently so as to perform the function they have been designed for.

The art does not teach how the above-mentioned magnetic material can be used in a production process in such a way, that in subsequent process steps multipolar permanently magnetized objects can be produced which incorporate the desired magnetic properties and magnetic pole configurations. In the case of pole regions of small dimensions, to be realized, e.g., on a multipolar rotor for a stepper motor with a diameter of up to 4 mm and sixty poles with alternatingly N- and Z-poles along its periphery, it is desirable to provide the product that is to be manufactured with strong magnetic poles already in the production stage. Although it is possible with the known method to establish high filling factors with the grains, it is extremely difficult, not to say impossible, to magnetize those afterwards to poles with a width of about 0.2 mm.

In order to solve this problem, the method according to the invention is characterized by the reduction of a strong, permanent magnet to fragments of fully magnetized anisotropic permanent magnet material, the reduction of the fragments of fully magnetized anisotropic material to grains, until all grains are smaller than the width of a pole region, mixing those grains with the hardening binding agent, inserting the mixture into the molding device, and ensuring that the mixture hardens in the molding device, thus providing the permanently magnetized object as the final product.

This method can be used particularly to obtain grains that are smaller than 150 μm or of another required size from desired, fully magnetized anisotropic permanent magnet material.

The invention also provides a method and a device for reducing fragments of fully magnetized anisotropic permanent magnet material, in which the fragments are introduced between grinder bodies of which at least the surfaces that face the fragments are made of the same magnetic material. Specifically the fragments are inserted between two grinder bodies of which at least the surfaces that face each other have mutually opposite magnetic poles.

Moreover, the invention provides a method in which the mixture inserted in the molding device is brought from at least a second molding body that is larger than but identical in structure to the first molding body to the first molding body through a passage member, with the periodical replacement of said filled first molding body by an identical molding body that is to be filled next, the first filled molding body providing a permanently magnetized object as the final product.

A special characteristic of this method and molding device is that the mixture is brought to the first molding body, while being subjected for at least a part of the passage member to magnetic forces originating from magnetic means near the surface of the passage member's inner circumference.

Another feature of the molding device is that at least the inner circumference of a cross-section of the passage member is identical in shape with the inner circumference of a molding body, the dimensions of the inner circumference gradually declining from that of the second molding body to that of the first molding body. The embodiment in which each cross-section near the inner circumference of the passage member is similar in structure to that of the molding body and the inner circumference of the passage member extends conically from the second molding body to the first molding body is preferred.

Additionally the molding device is characterized by an axially symmetrical presser means that, under axial displacement thereof in the molding device, presses the mixture in the direction of the first molding body, while the presser means, which is composed of a mandrel protruding at least partially into the molding device and having a closely fitting sleeve between the molding device and the mandrel for pressing the mixture to the first molding body, is preferred.

Another feature of the molding device is a mandrel provided with magnetic poles, on at least a part of its surface. The magnetic poles are aligned with poles that are situated near the inner circumference of the second molding body and of at least part of the passage member.

Such a molding device may comprise fixed ribs that extend partially or entirely between interpolar areas between the poles of the magnetic means in the mandrel and of the magnetic means in the molding device, the sleeve comprising a periphery which closely fits to these ribs and which can be displaced up to the passage member.

A system according to the invention is characterized by the above-mentioned molding device and grinding device, to which suitable supply and discharge means have been added.

BRIEF DESCRIPTION OF THE DRAWINGS

Further details, characteristics and properties will be elucidated in the following description. Several FIGURES will be referred to, of which.

DETAILED DESCRIPTION OF THE PREFERRED EMBODIMENTS

The merit of the invention can particularly be elucidated by means of FIGS. 1, 4, 8, 9, 10 and 11.

Figure 8:
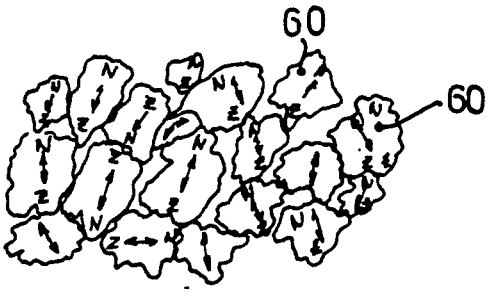
FIG. 8 represents a schematic view of the positioning of the fragments to be ground consisting of fully magnetized anisotropic permanent magnet material.
Figure 10A:
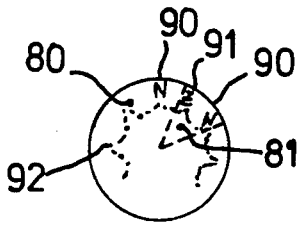
FIG. 10A, 10B, and 10C schematically represent a top view with enlargement and side view, respectively, of a permanently magnetized object as the final product, obtained with the molding device according to the invention; and, FIGS. 11A and 11B schematically represent a top view of a permanent- magnet body in the shape of a cylindrical sleeve, being provided with a ring in FIG. 11B.

FIG. 8 shows fragments (60) of fully magnetized anisotropic permanent-magnet material, which have been obtained by breaking a strong magnet of sintered permanent-magnet material such as $SmCo_5$ or $Sm_2Co_{17}$ or other desired strong, permanent-magnet material into small fragments. This material has to be reduced to grains, e.g., in a grinding device as described hereafter, and represents the starting material then. In order to have the grains take up a fixed position in the final product they are combined in a mixture with a hardening binding agent. From this mixture, an object (80) of small dimensions will have to be molded as can be seen in FIGS. 10A and 10C. This object could, e.g., be the rotor element of a stepper motor with stator poles of a timepiece, which rotor has a diameter of 4 mm and has along its periphery sixty pole regions (90, 91) arranged therein in alternating north poles N and south poles Z.

Figure 1:
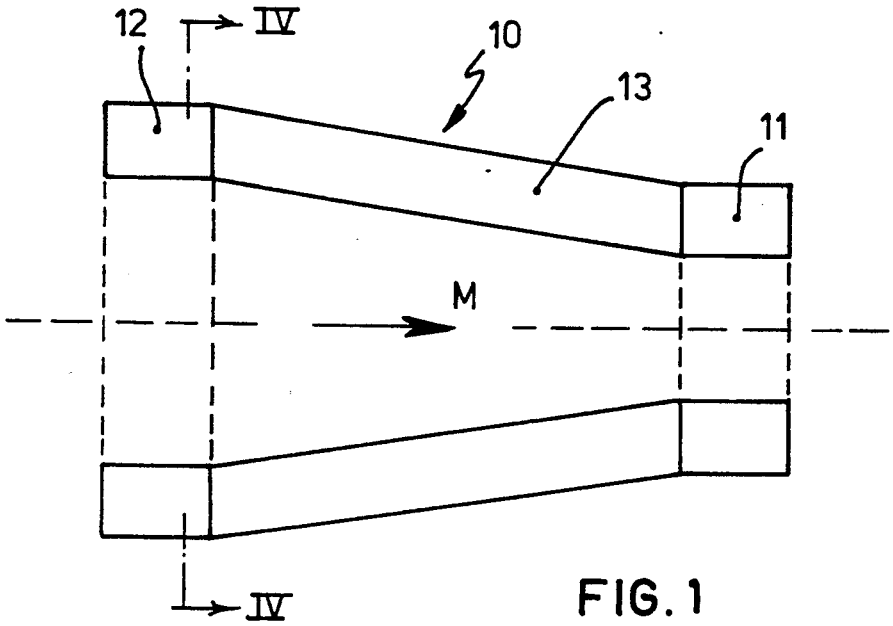
FIG. 1 represents a section along the axis of a schematically drawn molding device according to the invention.
Figure 4:
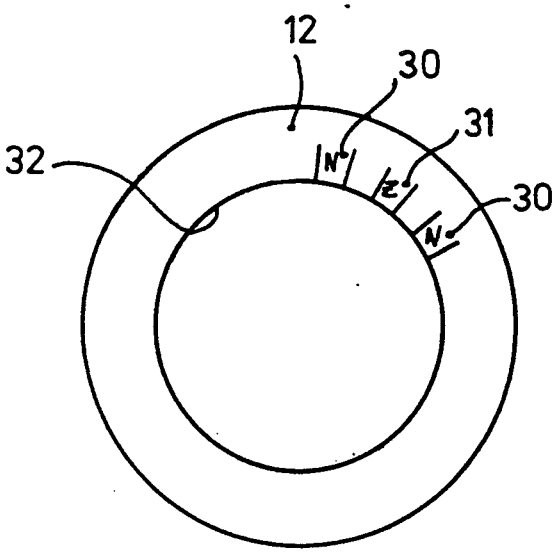
FIG. 4 shows a cross-sectional view along the line IV—IV in FIG. 1.

With reference to FIG. 1 in a molding device (10) for the production of such a rotor, the invention shows a first molding body (11), a second molding body (12), and a passage member (13) which can be connected between the two bodies. Both the molding bodies (11, 12) are identical in structure, however, they do not have the same size. They incorporate, inserted near their inner surfaces, magnetic means (30, 31) as indicated in FIG. 4, in which magnetic poles, referred to as N and Z for north and south, respectively, are situated at the inner circumference (32), of the molding bodies. The purpose of these magnetic means is to exert a magnetic influence on the mixture of the starting material and the hardening binding agent, and in particular on the portion near the inner circumference (32), in order to establish pole regions, particularly linking up at the N, Z poles, to which within the mixture a garland (92) of magnetic flux lines corresponds. This magnetic exertion begins with the introduction of the mixture into the second molding body (12). When carefully feeding the mixture through the molding device to the first molding body (11) in the direction of the arrow indicated by M, the pole patterns within the mixture will be maintained. When a part of the mixture has arrived in the first molding body (11) it will be able to harden there, or it will have hardened substantially or completely, enabling the first molding body (11) to be removed and replaced by a subsequent similar molding body, the filled first molding body thus providing a permanently magnetized object as a final product.

The magnetic means (30, 31) in the two molding bodies (11, 12) may be slices or discs of a desired permanently magnetic material.

Strong magnets with high remanence $B_r$ are preferred. For this purpose certain iron compounds, SmCo alloys such as $SmCo_5$, and $Sm_2Co_{17}$, as well as B-doped, Nd-Fe alloys are known.

The passage member (13) will preferably taper gradually from the second molding body (12) to the first molding body (11). E.g., the inner circumference can be a truncated cone, however, other shapes of the inner circumference are also possible. Preferably each cross-section of the passage member will have to be identical in shape with that of a molding body in order to disturb as little as possible the pole pattern formed within the mixture when passing it through the molding device.

For the two molding bodies, an inner circumference that is shaped as a regular polygon is also conceivable. In that case, each side of the polygon will have a magnetic N-pole or Z-pole. Accordingly, the passage member will be a truncated pyramid, its cross-section perpendicular to the axis being a regular polygon which is identical in shape with the cross-section of the two molding bodies. Provided there is a gradual transition, it is possible that the successive cross-sections of the passage member (13) start as circles and end as regular polygons, or the other way around, to which the two molding bodies (11, 12) have to fit accordingly.

In order to maintain the pole pattern in the mixture in the best possible way it is preferred to also apply magnetic means as found in the two molding bodies in at least a part of passage member (13) near the surfaces at the inner circumference. Slices or discs of a desired permanent-magnet material extending accordingly from the second molding body (12) in the direction of the first molding body (11) will prevent a possible disturbance of the pole patterns in the mixture. On the other hand, with the use of a suitable binding agent in the mixture, a passage member of iron or other soft magnetic material may offer a sufficiently conducting path to the magnetic flux lines from the poles in the mixture.

Suitable size ratios of the molding body (11, 12) are, e.g., 10 mm and 4 mm, for the respective inner diameters with a length of 30 mm for the passage member (13), i.e., the height of the truncated cone. However, other dimensions are also possible and even desirable if the hardening of the binding agent requires such. It will easily deviated from.

Figure 10B:
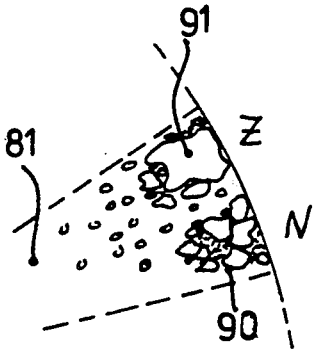
Figure 10C:
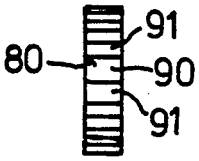

In FIG. 10B the dotted part in FIG. 10A of the object (81) to be produced is shown enlarged. The drawing represents a possible structure of pole regions (90, 91) composed of grains of fully magnetized anisotropic permanent-magnet material for a N-pole (90) and a Z-pole (91).

On the dimensions of the grains, the following can be remarked.

In order to make the poles in the pole regions (90, 91) of the final product (80) as strong as possible, it is necessary that the mixture in the pole regions comprises an as large as possible fraction of starting material. In other words: the filling factor, to be determined as the ratio of the volume of starting material per volume unit of mixture, should be as close to 1 as possible. Such a mixture should comprise grains of the maximally admissable size, viz. the width of a pole in the final product on the one hand, and a graded composition of smaller grains in order to fill up the space between the larger grains on the other hand. It should be remarked that the small grains are preferably not so small that they can form an inextricable conglomerate, which has a highly reduced magnetic moment as a whole, as a consequence of differences in orientation of the separate parts. Such a mixture will provide a minimal surface to be enveloped by the binding agent and will thus result in the largest possible filling factor.

From the above it can be easily deduced that the maximum pole width at the surface of an above-described rotor (80) with a diameter of 4 mm and with 60 poles is about 0.2 mm (=200 μm). For the grains to be positioned correctly and somewhat clustered at the poles, i.e., not within the interpolar regions, they should not be larger than about 150 μm. Similar calculations are possible for other rotor dimensions.

With the molding device (10) as discussed by means of FIGS. 1 and 4, having magnetic means (30, 31) on the inner circumference (32) of said molding device, the pole patterns can be established in the desired structure as indicated in FIG. 10B. It will be understood that when the mixture is introduced into the second, larger molding body (12) the grains can be positioned correctly.

Particularly in the second, larger molding body (12) the grains can be positioned in the right direction, for in said molding body the grains are the most movable on the one hand, since the binding agent is at its most fluid there, and because the grains will have enough space there to move on the other hand. Once they have been arranged in patterns, the pole patterns will be maintained in the passage member (13) up to the first molding body, where the final product is delivered as described above.

Before the mixture can be composed, the fragments (60) will have to be reduced to the above-described grains of desired dimensions. In this respect the following should be noted.

Figure 9:
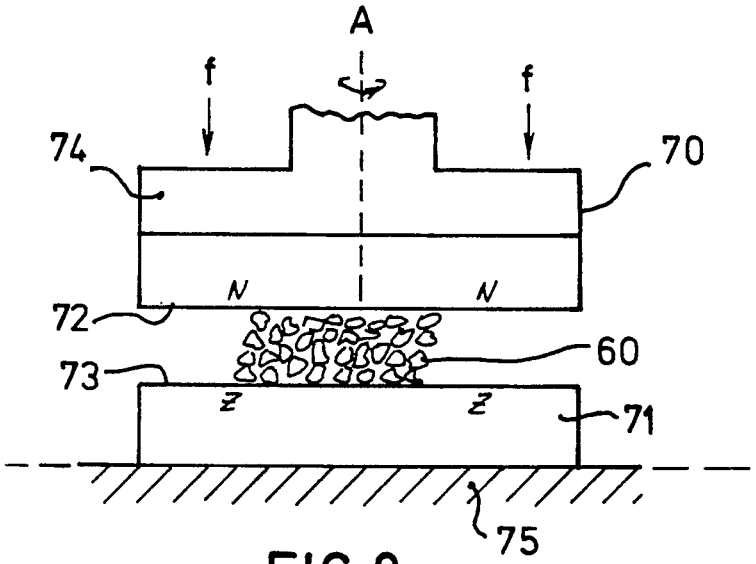
FIG. 9 schematically represents the grinding device according to the invention.

FIG. 8 shows a collection of fragments (60) of the fully magnetized anisotropic permanent-magnet material that is to be processed. These fragments have been obtained by the fragmentation of strong, permanent magnets of desired magnetic material into small fragments. These fragments (60) have to be reduced to granulated material or granulate of desired dimension. In order to prevent the fragments (60) and, after grinding, the grains from lumping into a head-to-tail arrangement, the present invention provides a solution by means of a grinding device, as schematically shown in FIG. 9. The fragments (60) are introduced between two grinder bodies (70, 71) with facing magnetic surfaces (72, 73) of matching polarity. Since the fragments (60) will be directed accordingly by this arrangement a more uniform processing of all the fragments is possible and the grains are more easily separated from one another after grinding. The grinder bodies (70, 71) can be permanent magnets, or electromagnets, or a combination of those. In order to conduct the flux lines these grinder bodies (70, 71) can partly consist of iron or another magnetic material, e.g., in a part (74) as indicated in FIG. 9. The grinder bodies (70, 71) can be rotated about a joint axis (A), and they can be pressed, adjustably or not, as indicated in the direction of the arrows (f). The entire grinding device can be combined with a yoke of suitable magnetic material, again intended to conduct the flux lines, and a bottom portion (75) can be integrated with the yoke.

The passage of the mixture through the molding device (10) in the direction of the arrow, indicated by M, can be established in several ways. The hardening rate of the binding agent, the length of the molding device (10) and its positioning (horizontally, inclined, vertically, with removable molding body (11) above or below) will also determine the passage of the mixture. Thus even the elimination of gravity can be taken into account. The passage will particularly be established by presser means (20, 21, 22, 23) as indicated in FIGS. 2A, 2B, 2C and 3. In these FIGURES, the displacement of these means has been indicated by arrows (a, b, c, d and e). It will be understood that the presser means preferably consists of non-magnetic material so as not to disturb the pole patterns. It can also be remarked that the filling material between the magnetic means (30, 31) is non-magnetic, e.g., a synthetic material or a metal, so that the flux line pattern at the inner circumference (32) of the molding device will not be disturbed either. Possibly the two molding bodies (11, 12) and, if necessary, the passage member (13), can be enveloped by a sleeve of magnetically conductive material in order to conduct the flux lines.

Figures 2A, 2B, 2C:
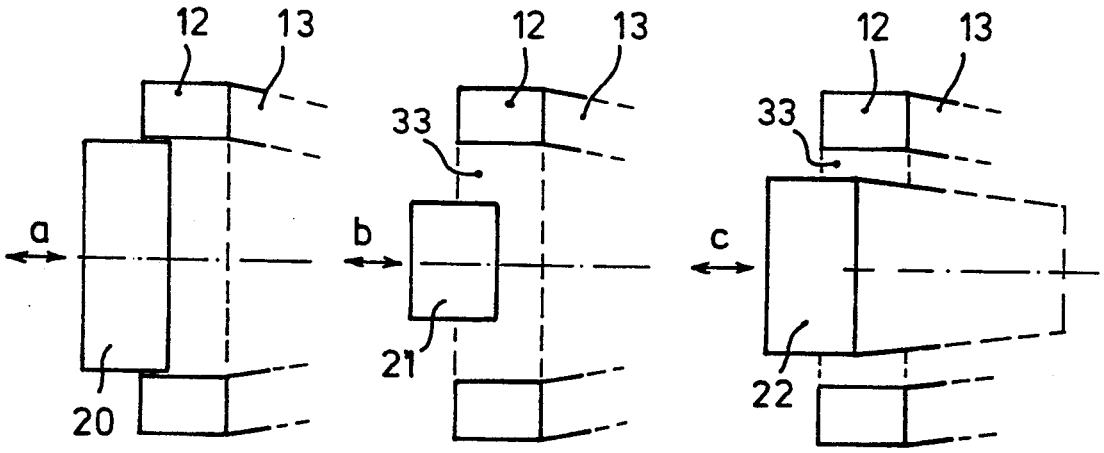
FIGS. 2A, 2B, and 2C represent a similar section of a part of the molding device, in which a presser means has been inserted into the molding device.

In FIG. 2A the presser means (20) is a cylindrical block that closely fits into the supply opening of the second molding body (12). When a large quantity of the present mixture is introduced into the molding device (10), the mixture can be pressed to the first molding body (11) by careful pressing, with which the pole pattern will have to be maintained, and during which in the meantime the mixture can be replenished, or the temperature can be increased or decreased for a part of the molding device. It is clear that the block (20) can only be displaced up to the passage member (13).

FIG. 2B shows an alternative way to leave an interspace (33) between the presser means (21), also being a cylindrical block, and the molding device (10). Although the length of the block (21) is the same as that in FIG. 2A, it may vary, dependent on the requirements at the used position of the molding device (10), the binding agent used, and the chosen passage length. It will be clear that the form and the cross-sectional dimensions of the interspace (33) are important to the maintenance of the pole pattern in the mixture. Preferably the respective circumferences of the block (21) and the inner circumference (32) of the second molding body (12) will be concentric with the axis of the molding device (10).

FIG. 2C shows a presser means in the form of a mandrel (22), also having an interspace (33) between the mandrel and the molding device (10) as indicated above, in which the interspace (33) extends over at least a part of the passage member (13). In a favorable way the mandrel (22) can extend up to the first molding body (11), contrary to the way it has been drawn in FIG. 2. The mandrel (22) may even end in a tip, at the point where the first molding body (11) begins, with a suitable diameter, chosen for that purpose, of the mandrel's cylindrical part and with an evenly tapering interspace (33) as indicated.

Figure 3:
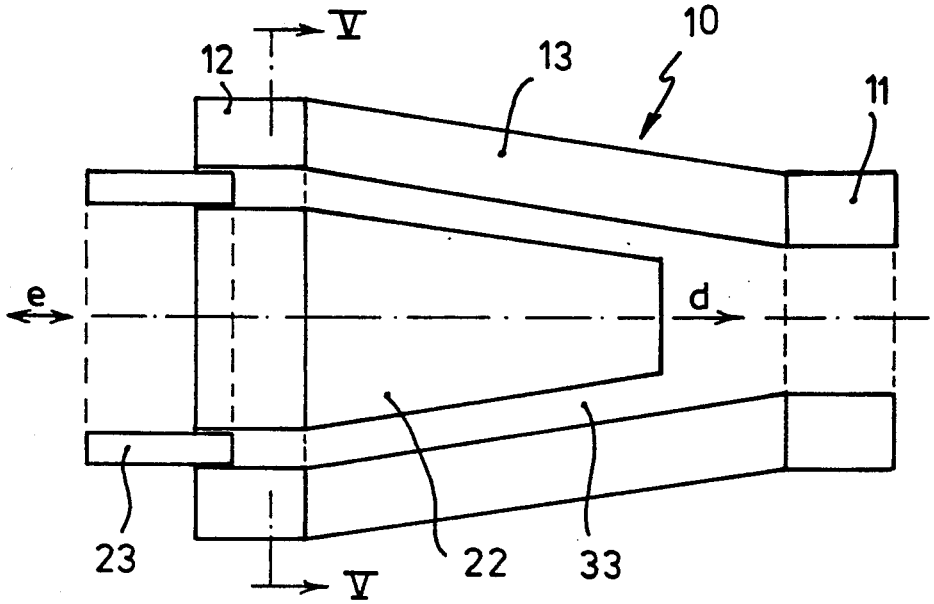
FIG. 3 also represents a longitudinal section along the axis of the schematically drawn molding device according to the invention, in which a composed presser means has been inserted into the molding device.

FIG. 3 shows a preferred embodiment of a presser means according to the invention. The presser means is composed of the above-described mandrel (22) and a cylindrical presser sleeve (23) to be displaced over the mandrel (22) into the second molding body (12) in a close-fitting arrangement. After insertion of the mixture and, subsequently of the mandrel, as indicated by the FIGURE, the mixture can be evenly pressed with the sleeve (23). Replenishment of the mixture, removal of the first molding body (11) and possible heating or cooling can be performed as indicated above. It will be clear that the sleeve (23) can be pressed up to the passage member (13).

Figure 5:
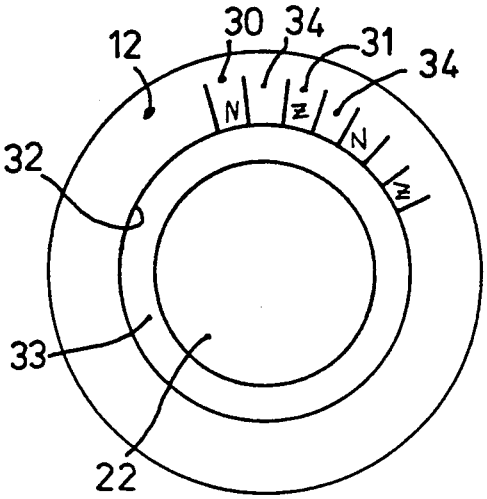
FIG. 5 shows a cross-sectional view along the line V—V in FIG. 3.

FIG. 5 shows a cross-section view along the line V—V in FIG. 3. Interpolar regions (34), situated between alternating N- and Z-poles, are also schematically indicated.

Figure 6:
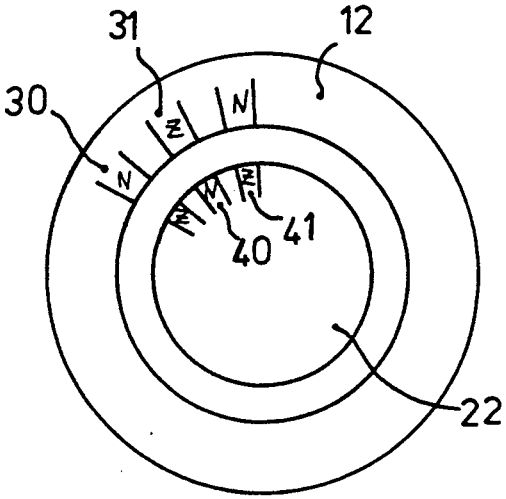
FIG. 6 represents a view similar to FIG. 5, in which the mandrel comprises magnetic means.

FIG. 6 shows a view similar to that of FIG. 5, but here magnetic means (40, 41) have also been incorporated in the mandrel (22). These magnetic means have alternating N- and Z-poles at the surface of the mandrel. When inserting the mandrel, the N- and Z-poles at the inner circumference (32) of the molding device (10), and the N- and Z-poles at the surface of the mandrel (22) will have to be aligned in the manner as drawn in the FIGURE. This may be established, e.g., by giving the mandrel (22) a fixed position with respect to the molding device (10). The thus formed magnetic domains in the mixture will have the shape of bar magnets according to this cross-section.

Figure 7:
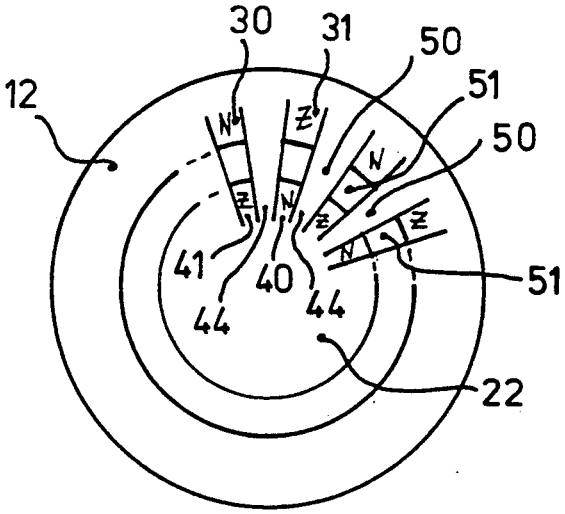
FIG. 7 gives a view similar to FIGS. 5 and 6, in which mandrel and molding device are connected by ribs.

FIG. 7 represents the case in which the interpolar regions (34,44) of the molding device (10) and the mandrel (22), respectively, are interconnected by ribs (50). These ribs can also only extend partially from the molding device (10) to the mandrel (22), or vice versa. In accordance with the three above-mentioned cases the presser sleeve (23) will comprise a cylindrical comb-like means, which fits into respective channels (51) as indicated in FIG. 7, or in the other cases, a sleeve wall provided with relief, fitting into grooves which will be formed between the protruding ribs (50). It has to be remarked that the ribs (50) may possibly not extend quite up to the first molding body (11). On the one hand this is induced by lack of room, on the other hand the "bar magnets" as indicated above would get so close to one another that further extending ribs would narrow down the pole regions of these bar magnets and thus hamper their effectiveness.

In order to have the pressing of the mixture performed as gradually and evenly as possible, the inner circumference (32) of the molding device (10) and the surfaces of the fixedly positioned mandrel (22) in FIGS. 5, 6 or 7, and of the ribs (50) in FIG. 7, can be provided with a lubricating coating, e.g., of Teflon®. The ribs (50) may also be entirely made of Teflon®.

In FIGS. 1 and 3 it has not been indicated that the first molding body (11) to be filled may comprise a bottom portion, with which also a shaft, extending from the bottom along the axis in the molding device (10), e.g., over the entire length of the molding body (11), can be provided. Such a recess could function as the place to secure a shaft. A magnetic object (80) thus formed, i.e, having the shape of a cylindrical sleeve, has been illustrated in FIG. 11A, showing a top view of such an object (80).

In order to further increase the filling factor, the method according to the invention for producing permanently magnetized objects of the type as described above may also comprise the mixing, in a suitable manner, of binding agent and starting material, and feeding this mixture to the molding device on the one hand, and sucking the mixture by means of vacuum into the first molding body (11) on the other hand. The first action is performed, e.g., by feeding the starting material through a thin layer of binding agent by channels or ducts, and particularly by drawing the starting material through it by means of magnets. In case of a molding device (10) according to FIGS. 5, 6 and 7 the channels are preferably injection molding channels. Along a supply end thereof, magnets can be periodically passed. Of course it is important that during this mixing, the layer of binding agent around a grain becomes as thin as possible. The second action, viz. sucking by means of vacuum, will ensure that possible air or gas bubbles are sucked off. The density of the starting material can be further improved by this method.

An object (80), obtained as final product with the above-described devices and methods, may have a shape as drawn in FIGS. 10A, 10C, showing a top and side view, respectively, of such an object. The N-and Z-poles (90, 91) applied therein alternate and in this way can provide a multipolar rotor for a stepper motor in a timepiece. In FIG. 11A, the possible recess (82), extending along the axis, destined for later securing of the rotor in a timepiece, has been drawn. If the dimensions of the shaft give rise to such action, it can be made of soft iron, so that it can serve as a magnetic conductor in the magnetic circuit of stator and rotor. It then forms a well-conducting internal return path for the permanent-magnetized poles of the rotor, and improves the external return path for the electromagnetically powered stator poles. The described magnetic function can also be performed by a plate, ring or collection of ring segments made of soft iron and inserted in the recess (82) in the rotor body (80). This has been illustrated by FIG. 11B, in which a ring (83) has been provided within the recess (82).

Multipolar rotors with diameters smaller than 4 mm can be produced by means of the above-described methods and devices. If such rotors are applied in stepper motors with a small stepping angle (e.g. 620 ) for timepieces this could result in a considerable saving of space in the timepiece housing.

Perhaps unnecessarily it is pointed out that the above-described method and devices can also be applied for producing other objects having polar regions arranged at the surface.

It will be clear to any expert that changes and alterations can be made in a suitable manner to the present methods and devices. One could, e.g., think of specially chosen atmospheric conditions. The object (80) could also incorporate an iron core or iron ring for conducting the flux lines. It goes without saying that such changes are not beyond the scope of the present invention, as determined in the enclosed claims.

I claim:

1. A magnetic object having a plurality of pole regions of small dimensions, wherein the object is adapted to be molded in a molding device by being subjected to a magnetic field and temperature changes, gravity, mechanical forces or combinations thereof, the object comprising:

a body of given shape which includes alternating spaced north and south pole regions, leaving interspace in interpolar regions, the distance between adjacent interspace defining a pole-pitch, said pole-pitch being less than 2 mm, wherein said body comprises:

a plurality of coarse grains of a fully magnetized anisotropic permanent magnet material, said grains being produced from a permanent magnet having an intrinsic coercive force of more than 5,000 Oersted by grinding the magnet until all grains have a size which is smaller than the pole-pitch, wherein in the pole regions at least those grains having a size smaller than but of the same range of size as the pole-pitch are aligned and distributed in accordance with a multipolar field pattern of said magnetic field; and a hardening binding agent which is mixed with said grains before being inserted in the molding device to form the magnetic object.

2. The magnetic object of claim 1 wherein said fully magnetized anisotropic permanent magnet material comprises an SmCo-alloy, having an intrinsic coercive force of about 10,000 Oersted.

3. The magnetic object of claim 1 wherein said grains have a maximum size of about 150 micrometers and wherein the pole pitch is about 200 micrometers.

4. The magnetic object of claim 1 wherein the total number of alternating poles at least equals sixty.

5. The magnetic object of claim 1 wherein said body comprises a cylindrical block having a cylindrical surface and wherein said alternating north and south poles are located near said cylindrical surface.

6. The magnetic object of claim 1 wherein said body comprises a cylindrical sleeve having a cylindrical surface and a central bore and wherein said alternating north and south poles are located near said cylindrical surface.

7. The magnetic object of claim 6 further comprising at least one ring segment made of soft iron, and wherein said at least one ring segment is provided in a central bore of said cylindrical sleeve.

8. The magnetic object of claim 6 further comprising a soft iron ring located in said central bore of said cylindrical sleeve.

9. The magnetic object of claim 6 further comprising a soft iron plate located in said central bore of said cylindrical sleeve.

10. The magnetic object of claim 1 wherein the object has an outer diameter which is smaller than approximately 5 mm.

11. A magnetic object having a plurality of poles, wherein the object is adapted to be molded in a molding device by being subjected to magnetic forces, temperature changes, gravity, mechanical forces or combinations of these forces, the object comprising:

a body having a circular outer periphery, and wherein said body includes a plurality of adjacent alternating spaced north and south pole regions leaving interspace in interpolar regions, the distance between adjacent interspace defining a pole-pitch, said pole-pitch being less than 2 mm, said body comprising:

a plurality of grains of a fully magnetized anisotropic permanently magnetic material, said grains being produced from a permanent magnet having an intrinsic coercive force of more than 5,000 Oersted by grinding the magnet into grains until all grains have a long dimension which is smaller than the pole-pitch having a filling factor of 50–80 percent and wherein in the pole regions at least those grains having to a long dimension which is smaller than but of the same range of size as the pole-pitch are located adjacent the alternating north and south pole regions; and a hardening binding agent which is mixed with said grains before the grains are inserted in the molding device to form the magnetic object.

* * * * *